US007575224B1

(12) United States Patent
Madland

(10) Patent No.: US 7,575,224 B1
(45) Date of Patent: Aug. 18, 2009

(54) RETRACTABLE BUNGEE CORD TIE DOWN

(76) Inventor: Erik Madland, 4817 105th La., Circle Pines, MN (US) 55014

( * ) Notice: Subject to any disclaimer, the term of this patent is extended or adjusted under 35 U.S.C. 154(b) by 76 days.

(21) Appl. No.: 11/671,941

(22) Filed: Feb. 6, 2007

Related U.S. Application Data

(60) Provisional application No. 60/765,570, filed on Feb. 6, 2006.

(51) Int. Cl.
*B66D 3/00* (2006.01)

(52) U.S. Cl. ..... 254/380; 254/376; 410/100; 410/103; 24/71 ST

(58) Field of Classification Search ..... 254/375, 254/376, 380; 410/100, 97, 103, 111, 112, 410/10, 11, 23, 34
See application file for complete search history.

(56) References Cited

U.S. PATENT DOCUMENTS

| | | | | |
|---|---|---|---|---|
| 2,623,760 | A | 12/1952 | Fornelius | |
| 2,967,046 | A | 1/1961 | Ratcliff | |
| 3,175,806 | A | 3/1965 | Prete, Jr. | |
| 3,848,889 | A * | 11/1974 | Sharrow | 410/103 |
| 4,227,286 | A | 10/1980 | Holmberg | |
| 4,542,883 | A | 9/1985 | Rutzki | |
| 4,622,721 | A | 11/1986 | Smetz et al. | |
| 4,842,458 | A | 6/1989 | Carpenter | |
| 5,042,159 | A | 8/1991 | Millen | |
| 5,282,706 | A | 2/1994 | Anthony et al. | |
| 5,368,281 | A | 11/1994 | Skyba | |
| 5,542,798 | A | 8/1996 | Rawdon et al. | |
| 5,722,640 | A | 3/1998 | Skyba | |
| 5,833,256 | A | 11/1998 | Gilmore | |
| 6,007,053 | A | 12/1999 | Huang | |
| 6,053,129 | A | 4/2000 | Akre | |
| 6,059,499 | A | 5/2000 | Bird | |
| 6,106,439 | A | 8/2000 | Boland | |
| 6,292,984 | B1 | 9/2001 | Nelson | |
| 6,405,683 | B1 | 6/2002 | Walter et al. | |
| 6,611,995 | B2 | 9/2003 | Jackson et al. | |
| 6,698,723 | B1 | 3/2004 | Antonini | |
| 6,698,983 | B1 | 3/2004 | Kiernan et al. | |
| 6,776,564 | B1 | 8/2004 | Kiernan et al. | |
| 6,789,329 | B1 | 9/2004 | Hester | |
| 6,793,449 | B1 | 9/2004 | Simpson et al. | |
| 6,899,497 | B2 | 5/2005 | Cardona et al. | |
| 6,904,872 | B2 | 6/2005 | Müller | |
| 6,908,269 | B1 | 6/2005 | Youngs et al. | |
| 6,915,058 | B2 | 7/2005 | Pons | |
| 6,925,967 | B1 | 8/2005 | Woodruff | |
| 6,957,495 | B1 | 10/2005 | Schmillen | |
| 6,957,938 | B1 | 10/2005 | Beasley | |
| 6,976,318 | B2 | 12/2005 | Odachowski | |
| 7,370,843 | B2 * | 5/2008 | Dueck | 254/277 |
| 2003/0190208 | A1 | 10/2003 | Cardona et al. | |

* cited by examiner

*Primary Examiner*—Emmanuel M Marcelo
(74) *Attorney, Agent, or Firm*—Moss & Barnett

(57) ABSTRACT

A retractable bungee cord tie down having a housing enclosing a ratcheting mechanism and a bungee cord. The bungee cord is wrapped around a spool having a biasing member operatively coupled thereto to permit automatic retraction of the bungee cord into the housing. Operatively coupled to the spool is a control arm that is used to engage and disengage spool movement and thus movement of the bungee cord into or out of the housing. A button connected to the control arm permits a user to secure items by securing the bungee cord first and then operating or moving the housing to another secure location.

19 Claims, 11 Drawing Sheets

RETRACTABLE BUNGEE CORD TIE DOWN

CLAIM OF PRIORITY

The present invention claims the benefit of U.S. Provisional Application Ser. No. 60/765,570 filed on Feb. 6, 2006 and incorporated herein in its entirety by reference.

BACKGROUND OF THE INVENTION

1. Field of the Invention

The present invention relates to an apparatus for restraining movement of cargo or items with respect to a non-moveable structure or themselves. More particularly, the present invention is related to a retractable bungee cord tie down that is easily operated with a single hand of a user.

2. Description of Related Art

Tie downs for securing items is widely known. The most conventional tie down is the buckle tie down. The buckle tie down includes an adjustable strap operatively woven in a ratcheting buckle. The adjustable strap includes a hook for attaching to a loop or hole structure of a vehicle or to the strap itself A leader or fixed strap and hook is typically connected to the ratcheting buckle. The ratcheting buckle includes a handle and a bale or spool. To use the ratcheting tie down the hook of the fixed strap is attached to loop or hole of a vehicle. The hook of the adjustable strap is hooked to another loop or hole. A user than applies tension to the buckle by repeatedly ratcheting the handle. This draws the adjustable strap onto the bale.

Attached to the bale of the buckle is a ratcheting mechanism that typically includes ratchet teeth and a spring-pressed holding pawl to prevent reverse rotation of the bale. A spring-pressed driving pawl is also typically provided to rotate the bale in a winding direction.

Ratcheting buckle tie downs are complicated devices that are not easy to operate. Both the hook of the non-elastic strap and the end of the leader strap must be connected before ratcheting the handle of the buckle. The weight of the buckle often creates a sag in the tie down that can result in the hooks becoming disconnected from the loops or holes. Additionally, it is not uncommon for the buckle to become positioned (such as between two articles being retained) so that it becomes difficult to operate the ratcheting buckle. Another problem with the ratcheting buckle is that the repeated ratcheting motion required to increase tension is time consuming and difficult. Users having limited strength or dexterity find it difficult to use.

Releasing the tension of the ratcheting buckle is often times more difficult than ratcheting the buckle. To release the tension the spring-pressed holding pawl has to be lifted to free the bale. Unfortunately, the tension on the bale and ratcheting teeth is often times greater than the strength of an average person. As a result, often times a user has to utilize a tool such as a pliers or screwdriver to release the tension.

Storage of a ratcheting buckle tie down is also problematic. Once a user no longer needs the buckle tie down they have to ratchet the entire length of the adjustable strap for storage. In the interest of saving time, most users elect not to ratchet the adjustable strap completely, instead, opting to throw the adjustable strap and buckle into a pile in a vehicle or work room. As a result, the tie down becomes tangled thereby requiring the user to spend a considerable amount of time untangling the tie down prior to its next use.

Another device widely known to secure items is a bungee cord. The bungee cord typically includes an elastic cord having a pair of hooks attached to opposed ends. The bungee cord is used by hooking one of the hooks to a loop or item and then stretching the bungee cord to another loop or item and attaching the hook thereto. The problem with a bungee cord is that they are only able to extend or stretch to a predefined length. This limitation has resulted in manufacturers producing bungee cords in various sizes and tensions. It is inevitable that when a bungee cord is needed, the only one available will be an incorrect size or tension. If the bungee cord is too small it will not reach between the loops or hooks. If the bungee cord is too long a user will be required to repeatedly wrap the bungee cord around the item or items being secured.

What is needed in the industry is an adjustable tie down that is easy to operate and does not require additional tools. What is also needed in the industry is a device that is easily retracted, stored, and accessible for repeated use.

SUMMARY OF THE INVENTION

The present invention includes a retractable bungee cord tie down having a housing enclosing a ratcheting mechanism and a bungee cord. The bungee cord is wrapped around a spool having a biasing member operatively coupled thereto to permit automatic retraction of the bungee cord into the housing. A control arm can be operatively coupled to the spool to control the engagement and disengagement of the movement of the spool. An actuator button or similar structure can be operatively connected to the control arm to permit a user to selectively control engagement and/or disengagement of the spool's management.

In an example of operation, a user secures a free end of the bungee cord to a first securing point such as a loop, a hook, or other structure. The user depresses the button that causes the control arm to disengage from the spool. The spool is then permitted to freely rotate. The user is then able to move the housing, which causes the spool to unwind, and release a length of the bungee cord. Prior to reaching a second securing point a user can cease depressing the button thereby permitting the control arm to reengage the spool. The spool is prevented from rotating and possibly discharging an additional length of the bungee cord. As the user connects the housing to the second securing point the bungee cord is stretched. By stretching the bungee cord a user increases the tension in the bungee cord thereby preventing movement of the item or items being secured.

In an example of the invention, a retraction control mechanism is provided to control retraction of the bungee cord into the housing. The retraction control mechanism may be operatively coupled to the housing to engage the spool or bungee cord directly or indirectly. By engaging at least a portion of the spool and/or the bungee cord, the retraction control mechanism is capable of reducing the rotation of the spool and thus the retraction of the bungee cord. By controlling the rate of retraction of the bungee cord the user is able to eliminate any possible damage that it may cause. Additionally, the controlled retraction also facilitates proper storage of the bungee cord by eliminating any bunching of the bungee cord within the housing as it is being retracted.

BRIEF DESCRIPTION OF THE DRAWINGS

Referring now to the drawings, wherein like reference numerals indicate corresponding structure through the several views.

DETAILED DESCRIPTION OF THE PREFERRED EMBODIMENT

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

Figure 1:
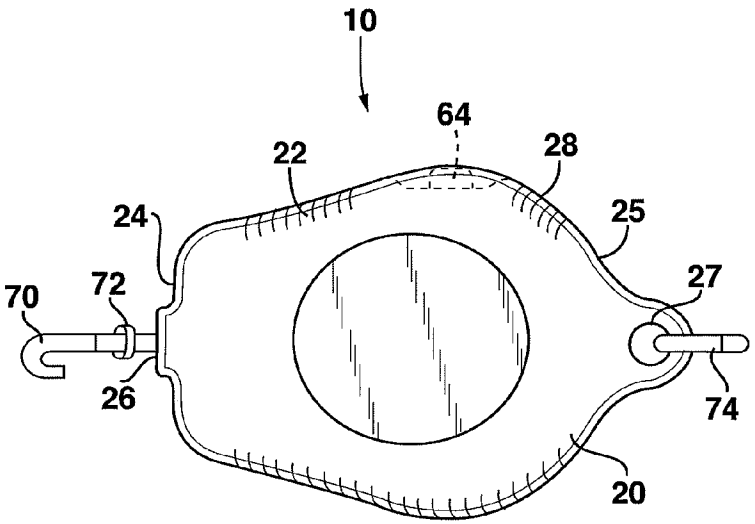
FIG. 1 is a side view of the retractable bungee cord tie down.

Referring now to FIG. 1, the retractable bungee cord tie down is indicated by the numeral 10. In an example embodiment of the invention, the retractable bungee cord tie down 10 includes a housing 20, at least partially enclosing a ratcheting mechanism 40 to which is retractably coupled a length of bungee cord material 50. Although a bungee cord material is described as the preferred embodiment of tether, it should be understood that the invention could also be manufactured with other tethers such as cord, straps and the like, whether generally elastic or not.

Figure 2:
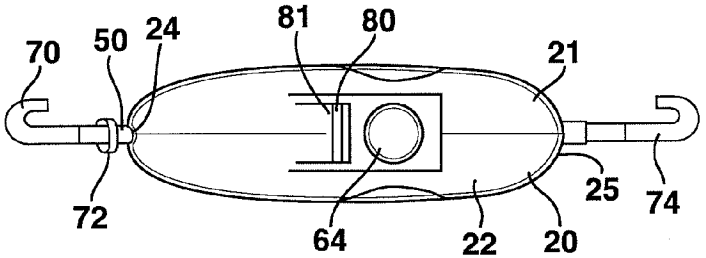
FIG. 2 is a top view of the retractable bungee cord tie down illustrating an actuating member.

Referring to FIGS. 1 and 2, the housing 20 can include a first housing portion 21 and a second housing portion 22 that can be joined together to form an interior 23 (see FIG. 7). The housing can also include a first end 24 and a second end 25. The first end 24 of the housing 20 can include at least one opening 26 extending into the interior 23. The housing 20 can be manufactured from any material such as plastics, metals, and the like. An exterior surface of the housing 20 can include a plurality of ridges 28, groves, ribs, and the like to increase a user's grip on the housing 20. The ridges 28 can be molded into the housing 20 if made from plastic. It is also possible to have the ridges 28 manufactured from a rubber material and the like. The rubber would have an increased coefficient of friction and would therefore reduce the possibility of the housing 20 from slipping out of a user's hand.

Figures 12A, 12B:
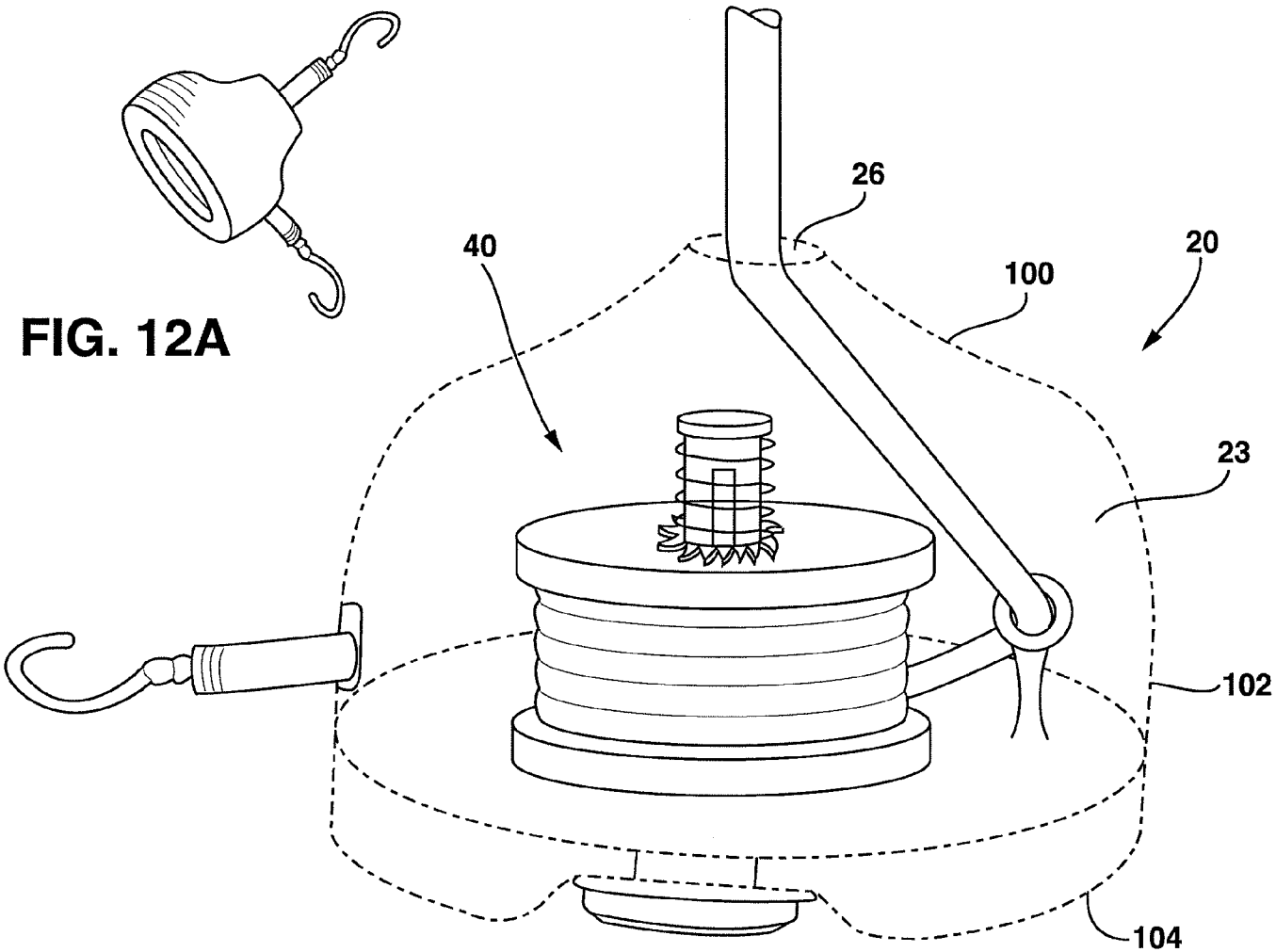
FIG. 12A is another example of a bungee cord tie down.
FIG. 12B is a perspective view of the example bungee cord tie down of FIG. 12A with the housing in phantom.
Figure 13A:
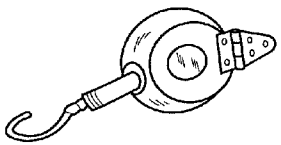
FIG. 13A is another example of the bungee cord tie down.
Figure 14A:
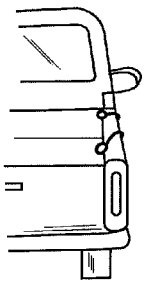
FIGS. 14A-14F are examples of the bungee cord tie down securing items.
Figure 14B:
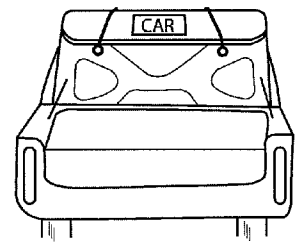
Figure 14C:
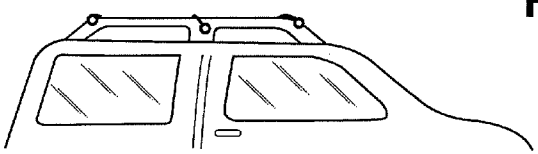
Figure 14D:
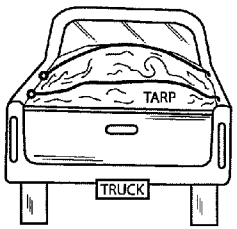
Figure 14E:
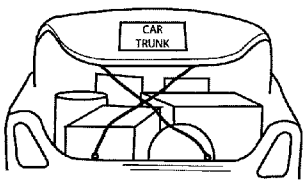
Figure 14F:
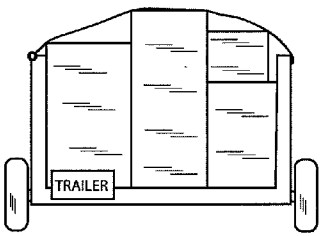

Referring to FIGS. 12A and 12B, housing 20 can include a casing having a back wall 100 and a peripheral wall 102 extending therefrom. A cover or plate 104 can be removably fixed to the peripheral wall 102 or back wall 100 to form the interior 23. In this embodiment, the housing 20 would also include the opening 26 extending into the interior 23 which would house the ratcheting mechanism 40. The housing 20 of this embodiment can be manufactured from the same materials as described above and can also include ridges 28 and the like to increase a user's grip on the housing 20. Of course numerous modifications to the housing 20 are possible and those described should not be considered limiting. For example, an attachment means can be so mounted to the housing 20 to permit the housing to be securely mounted to structures such as those illustrated in FIGS. 14A-14F.

Figure 3:
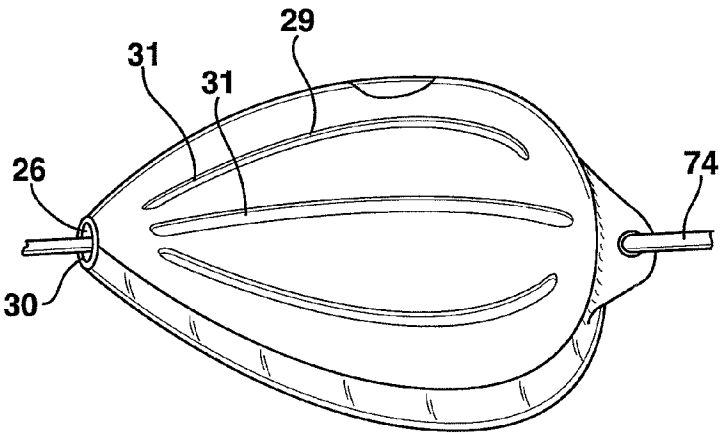
FIG. 3 is a side view of the retractable bungee cord tie down enclosed by a bumper.
Figure 6:
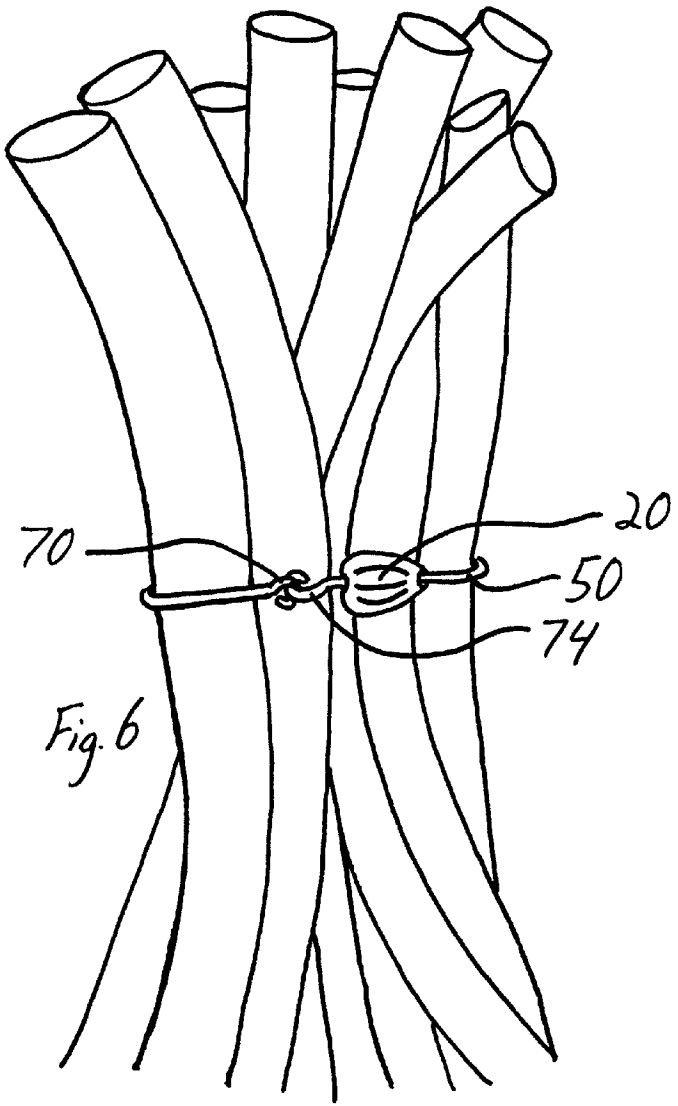
FIG. 6 is a side view of the retractable bungee cord tie down securing items together.
Figure 5:
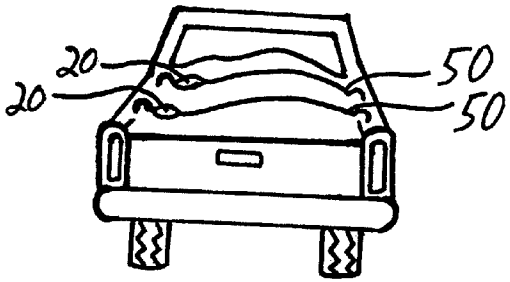
FIG. 5 is a perspective view of the retractable bungee cord tie down securing items in the bed of a truck.
Figure 4:
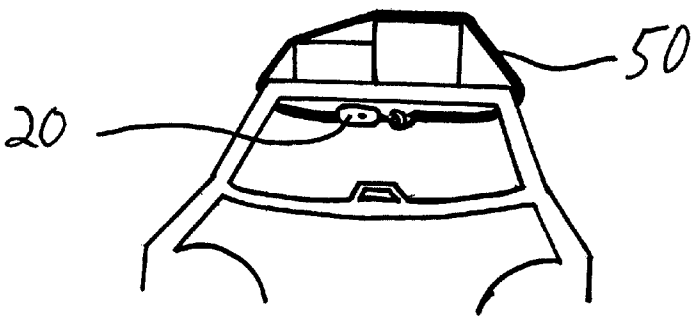
FIG. 4 is a perspective view of the retractable bungee cord tie down securing items to a roof of a vehicle.

Referring to FIG. 3, a cover or bumper 29 can be disposed over the housing 20 to protect the housing 20 from damage, dirt, and debris. The bumper 29 can also protect the item or items being secured. The bumper 29 can also protect a vehicle in which the housing 20 is being used to secure the items. The bumper 29 permits the users to use the retractable bungee cord tie down 10 without fear that the housing 20 will scratch the vehicle's paint. In one embodiment, the bumper 29 completely encloses the housing 20 except for an opening 30 that is in registration with the opening 26 of the housing 20. The bumper 29 can comprise any compressible material such as rubber coated foam or any generally non-compressible material such as rubber. In one embodiment of the invention, the bumper 29 can also include a plurality of ridges 31, groves, depressions, and the like formed thereon for providing a gripping area for a user's hand. The ridges 31 can be manufactured from a different material such as rubber, foam, plastic, and the like. Various materials and configurations are possible. Therefore, the description provided herein should not be considered limiting.

Referring to FIGS. 2, 7A-11, the ratcheting mechanism 40 is disposed in the interior 23 of the housing 20. In one embodiment of the invention, the ratcheting mechanism 40 includes a spool 41 rotatably mounted to an inner surface of the first housing portion 21 and the second housing portion 22. The spool 41 includes a cylindrical drum or hub 42 and opposed operatively disposed disks 43*a* and 43*b* spaced apart on the hub 42. Each of the disks 43*a* and 43*b* can include an outer surface having a plurality of teeth 44*a* formed therein. The plurality of teeth 44*a* can be disposed generally proximate to free edges 45*a* and 45*b* of the disks 43*a* and 43*b* respectively to permit easy engagement and disengagement of the ratcheting mechanism 40. The plurality of teeth 44*a* can be concentrically spaced about the outer surface of the disks 43*a* and 43*b*.

The spool 41 can be manufactured from a generally rigid material such as aluminum or steel. However, the spool 41 can also be manufactured from a plastic material to lighten the overall weight of the housing 20. Various materials and configurations are possible. Therefore, the description provided herein should not be considered to be limiting.

Figure 7A:
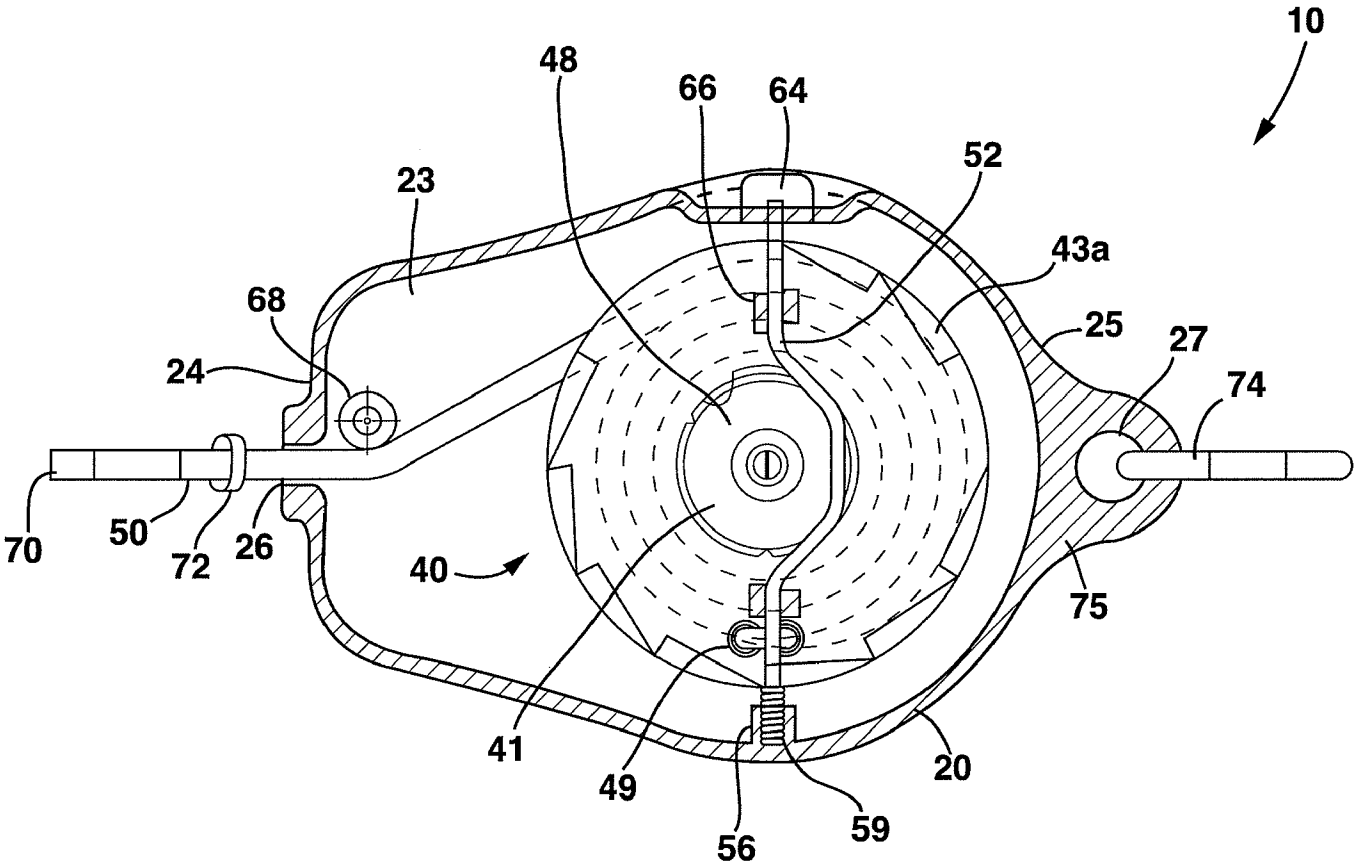
FIG. 7A is a cross section view of a housing for storing the retractable bungee cord.
Figure 7B:
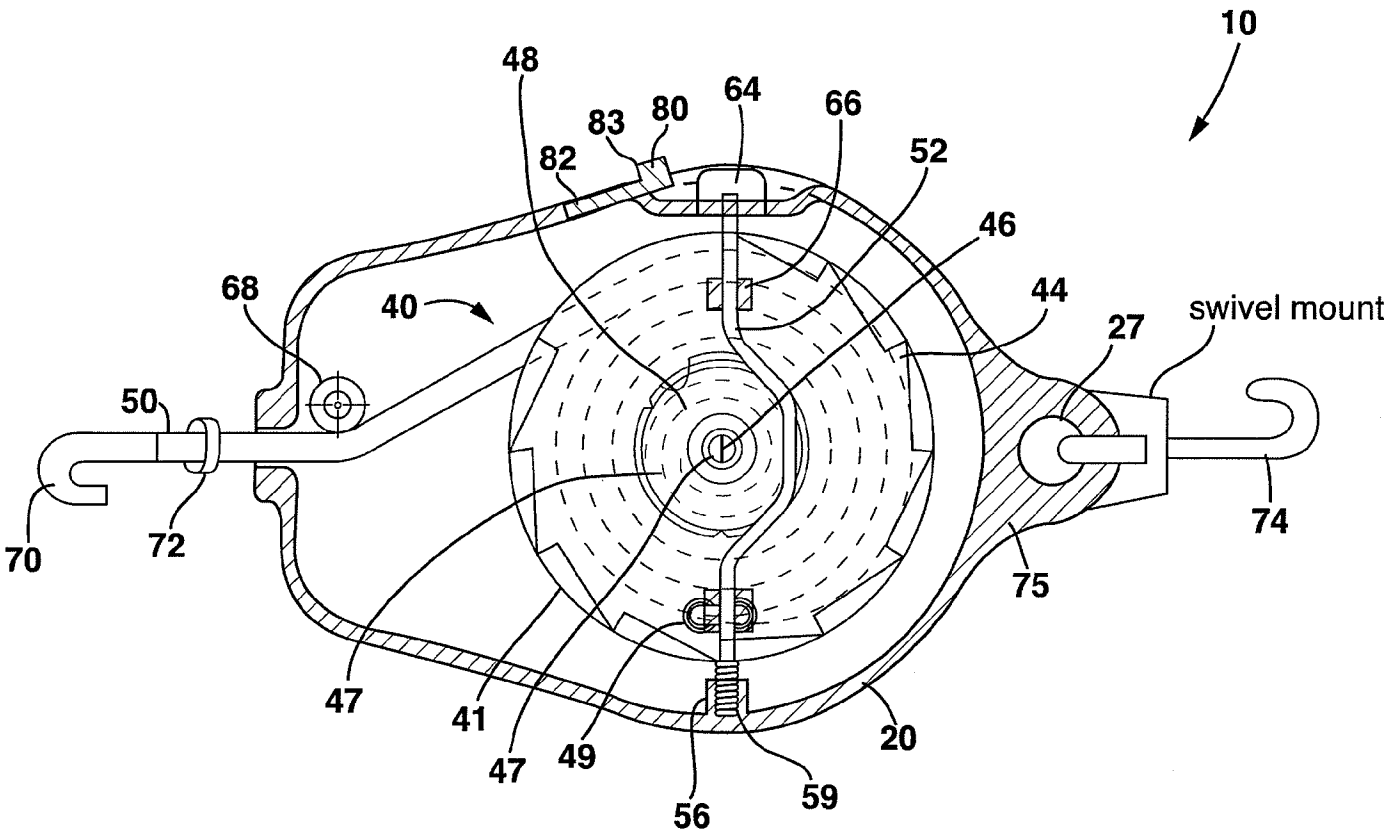
FIG. 7B is a cross section view of a housing for storing the retractable bungee cord.
Figure 7C:
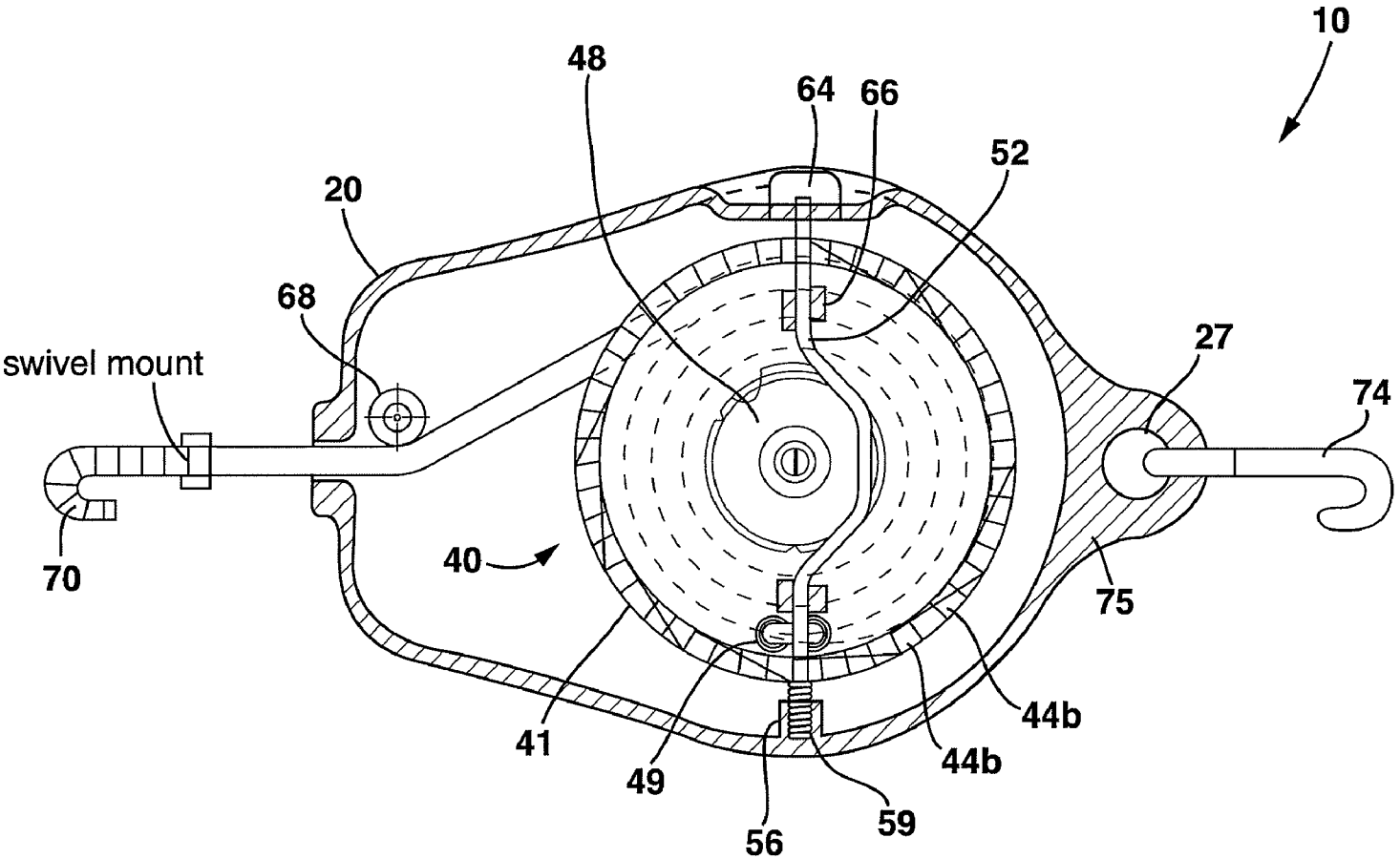
FIG. 7C is a cross section view of a housing for storing the retractable bungee cord.
Figure 8:
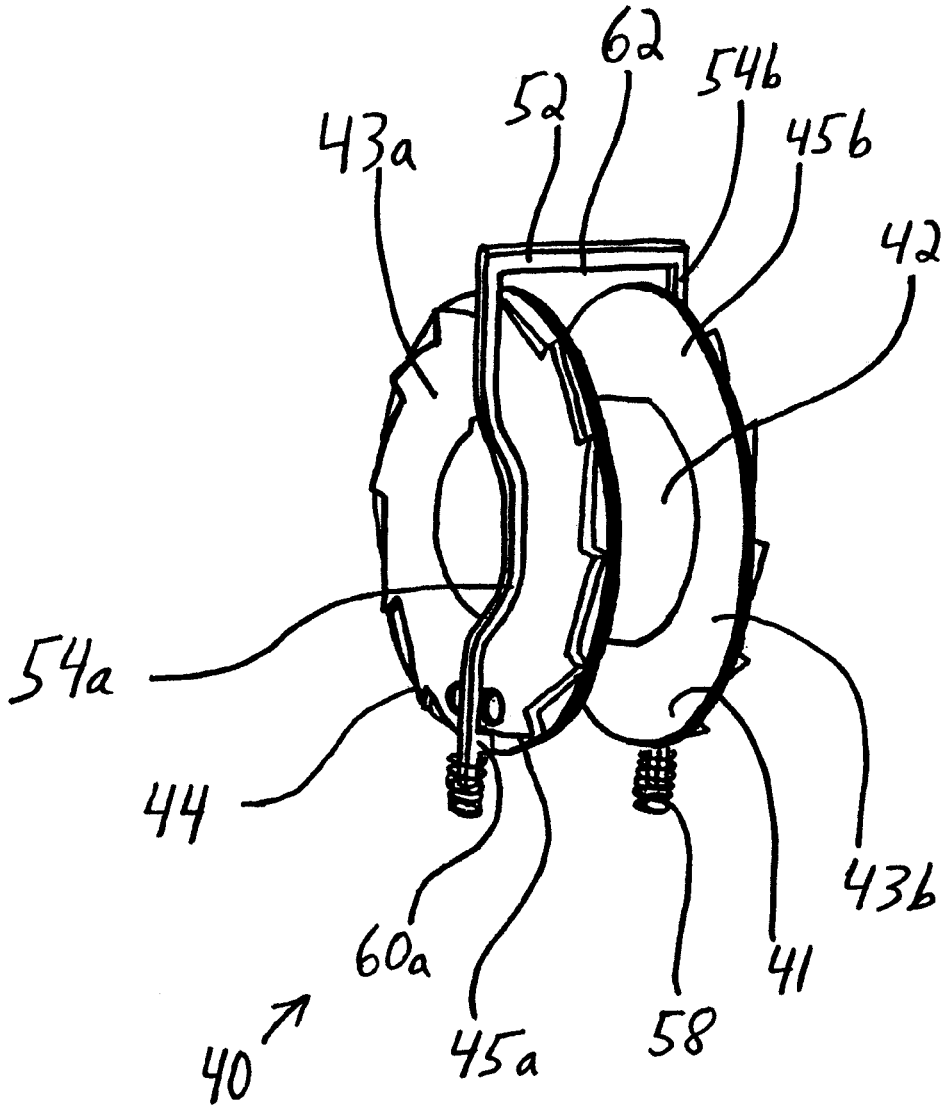
FIG. 8 is a perspective view of a spool with teeth and a spring-biased control arm.
Figure 9:
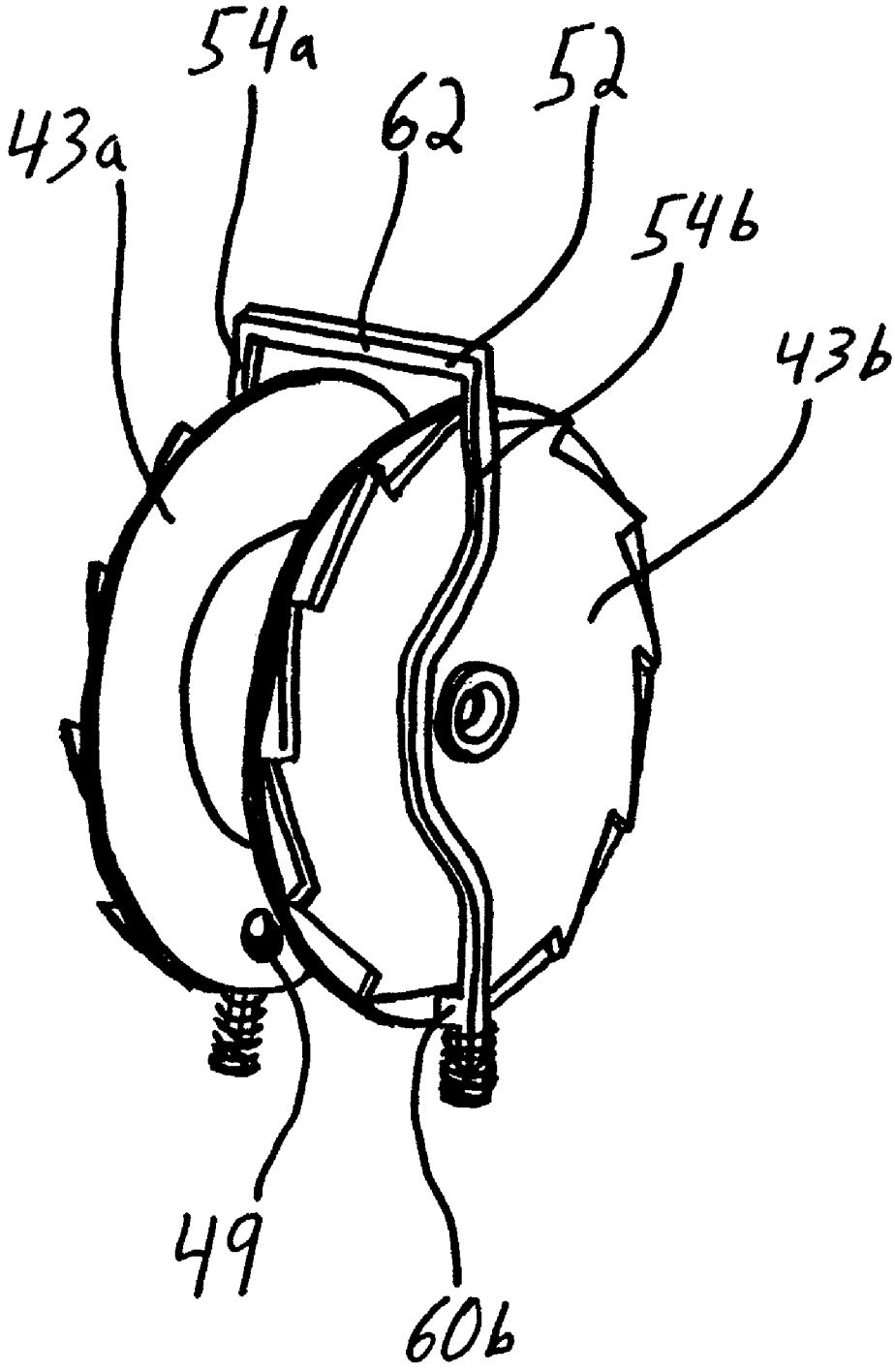
FIG. 9 is a another perspective view of the spool with teeth and a spring-biased control arm of FIG. 8.

Referring particularly to the example embodiment depicted in FIG. 7C, the disks 43*a* and 43*b* can include a plurality of notches 44*b* instead of teeth 44*a*. Each of the notches 44*b* is preferably proximate the free edges 45*a* and 45*b* of the disks 43*a* and 43*b*. Similar to the teeth 44*a*, the notches 44*b* are repeated about a circumference of the disks 43*a* and 43*b*. The depth and spacing of the notches 44*b* or the size of the teeth 44*a* can vary. Therefore, the Figures should not be considered limiting.

The spool 41 can be rotatably disposed between the first housing portion 21 and the second housing portion 22. In one embodiment of the invention, the spool 41 is rotatably mounted on a shaft 46 or spindle that extends from at least one of the housing portions 21 and/or 22 and connects or abuts the other housing portion. In another embodiment, the shaft 46 includes first and second shaft portions that extend from the first and second housing portions 21 and 22 respectively. In this embodiment, the shaft portions can engage each other inside the hub 42 of the spool 41.

The spool 41 can be rotatable in a first direction characterized by the bungee cord 50 being withdrawn from the housing 20. The spool 41 is also rotatable in a second direction characterized by the bungee cord 50 being drawn or retracted back into the housing 20. One of the novel features of the present invention is the ability of the user to control movement of the spool 41 and thus the bungee cord 50 in the first and/or second directions.

To control movement of the spool 41, the ratcheting mechanism 40 includes a biasing member 47 disposed in the hub 42. The biasing member 47 can comprise a coiled spring operatively coupled to an interior surface of the hub 42 and a portion of the shaft 46. The biasing member 47 provides automatic retraction of the bungee cord 50 into the housing 20 when the ratcheting mechanism 40 is disengaged. Any type of biasing member 47 can be used such as leaf type springs and the like. Those skilled in the art will appreciate that the biasing member 47 can also be operatively disposed between the spool 41 and any portion of the housing 20.

Referring particularly to FIGS. 7A, 7B, and 7C at least one spool cap 48 can be mounted on the spool 41 to generally enclose its interior and prevent debris and other foreign objects from entering. Additionally, the spool cap 48 can be used to ensure that the biasing member 47 is retained within the hub 42. This can be particularly important due to the increased tension that the biasing member 47 will be under when the bungee cord 50 is fully withdrawn from the housing 20. Since the shaft 46 will need to extend at least partially into or through the hub 42, the spool cap or caps 48 preferably have a central aperture extending therethrough for receiving the shaft 46.

At least one of the disks 43*a* or 43*b* can include a securing mechanism 49 either formed therein or attached thereto that secures one end of the bungee cord 50 in the housing 20. In one embodiment, the securing mechanism 49 includes at least one hole extending through one of the disks 43*a* or 43*b* so that the bungee cord 50 can be feed through the hole and then tied into a knot. The knot prevents the bungee cord 50 from feeding back through the hole and escaping from the housing 20. In another embodiment, the securing mechanism 49 includes a pair of holes proximate each other extending through one of the disks 43*a* or 43*b*. In this embodiment the bungee cord is fed through both holes and then tied into a knot which prevents it from being fed back through the holes. Additionally, the weaving of the bungee cord 50 through the holes increases the friction exerted upon it, thus decreasing the likelihood that it will come free from the securing mechanism 49. In yet another embodiment, the securing mechanism 49 can include an arrangement of components that grip, pinch, or squeeze the bungee cord 50.

After one end of the bungee cord 50 is secured to the securing mechanism 49 it is wound about the hub 42 of the spool 41. A free end of the bungee cord 50 is then feed through the opening 26 of the housing 20. As the bungee cord 50 is drawn out of the housing 20 the spool 41 begins to rotate. The rotation of the spool 41 increases the tension applied to the biasing member 47. When the bungee cord 50 is no longer needed it is automatically feed back into the housing 20 by the tension stored in the biasing member 47. The tension in the biasing member 47 causes the spool 41 to rewind and draw the bungee cord 50 back into the housing 20.

Referring to FIGS. 7*a*-11, the ratcheting mechanism 40 can also included a control arm 52 for controlling the rotation of the spool 41 and thus the withdrawal and intake of the bungee cord 50. The control arm 52 controls the bungee cord 50 by engaging and disengaging the spool 41. In one embodiment, the control arm 52 includes a pair of spaced leg portions 54*a* and 54*b* that are disposed proximate the disks 43*a* and 43*b* respectively such that the spool 41 is disposed there between. Each of the leg portions 54*a* and 54*b* may include a bow formed to provide for clearance of the spool 41, hub 42, and/or spool cap 48. This configuration would reduce the amount of space needed in the interior 23 of the housing 20 thereby making the overall size of the device smaller and easier to use.

The leg portions 54*a* and 54*b* can also include a free end 55*a* and 55*b* respectively that is operatively disposed in a seat 56 formed on each of the housing portions 21 and 22. The seat 56 can comprise an annular wall molded into the housing portions 21 and 22. The annular wall can create a cavity that can hold a spring of bias member 59 or other bias member. The free ends 55*a* and 55*b* of each of the leg portions 54*a* and 54*b* can be disposed in the seat or seats 58 and through the spring 59.

Figure 10:
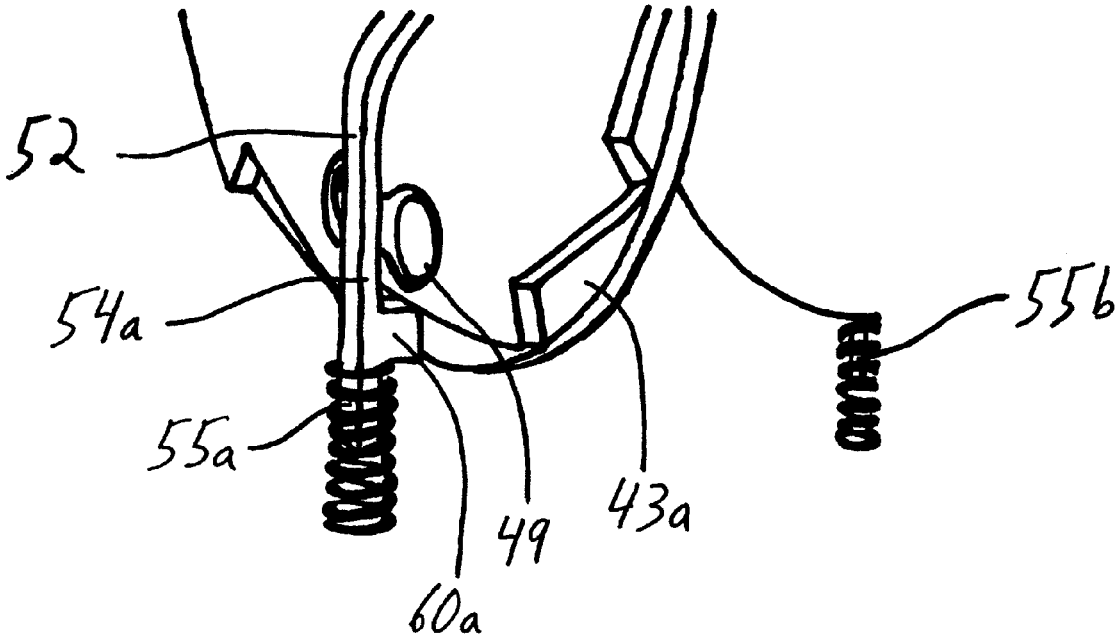
FIG. 10 is an enlarged perspective view of the spring-biased control arm disposed in the teeth of FIG. 8.
Figure 11:
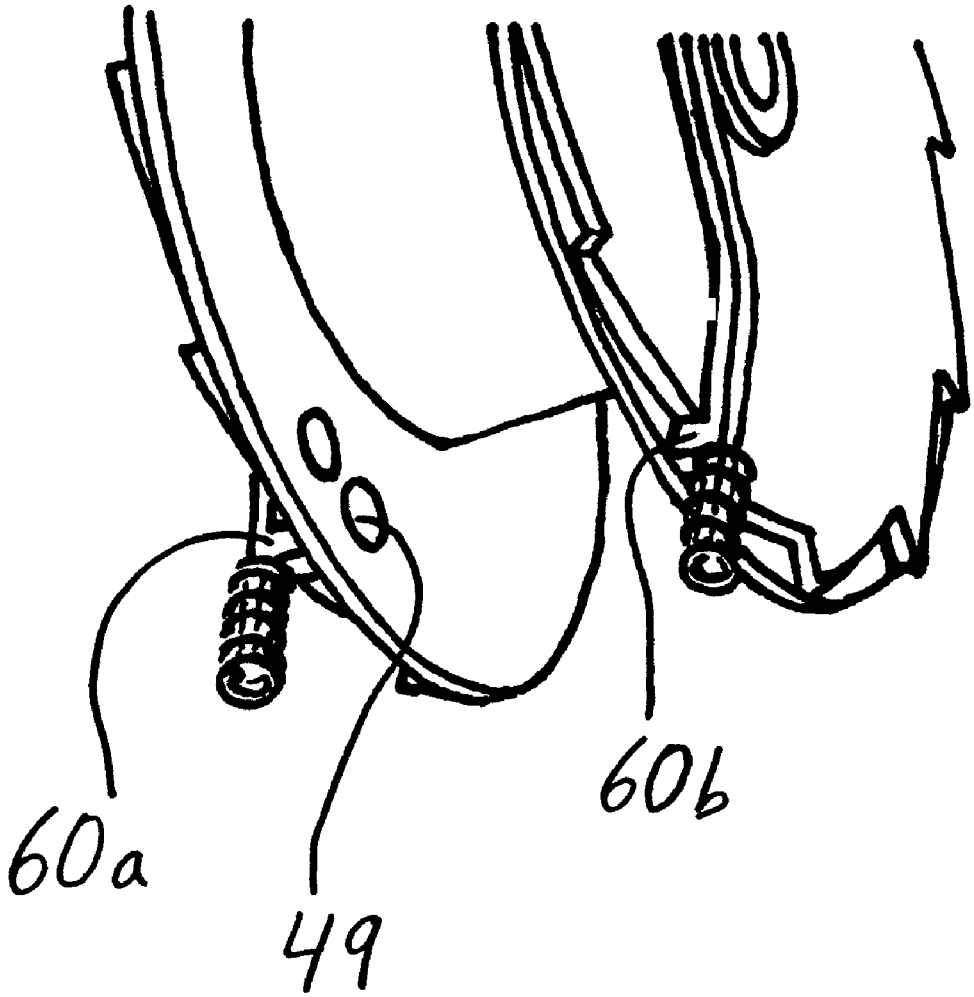
FIG. 11 is a bottom perspective view of a spool with teeth and a spring-biased stop portion or pawl.

Referring particularly to FIGS. 10 and 11, there can be stop portions 60*a* and 60*b* extending away from an inner surface of each of the leg portions 54*a* and 54*b* respectively. Each of the stop portions 60*a* and 60*b* can be positionable between an engaged position, where they are engaged with the teeth 44*a* or notches 44*b* to stop movement of the spool 41 in either the first direction or the first and second directions respectively, and a disengaged position where they are confronting the spring or bias member 59 that can move them from the disengaged position toward the engaged position.

In the embodiment having a spool 41 with teeth 44*a*, the stop portions 60*a* and 60*b*, engaged with the teeth 44*a*, stop rotation of the spool 41 in at least a first direction such that the bungee cord 50 is prevented from being withdrawn from the housing 20. In this embodiment, the bungee cord 50 is still free to be automatically retracted into the housing 20. The stop portions 60*a* and 60*b* are free to move over the teeth 44*a* to allow automatic retraction of the bungee cord 50 into the housing 20.

In the embodiment having a spool 41 with notches 44*b*, the stop portions 60*a* and 60*b* stop rotation of the spool 41 in the first direction and in a second direction when they are disposed in the notches 44*b*. In this embodiment, the bungee cord 50 will remain in its state until the user decides to permit the bungee cord 50 to be drawn into or retracted out of the housing 20.

In both embodiments the ratcheting mechanism 40 must be disengaged to withdraw the bungee cord 50 from the housing 20. To facilitate disengagement a connector portion 62 extends between and connects the leg portions 54*a* and 54*b* of the control arm 52. A button 64 operatively disposed in the housing 20 can be in operative engagement with the connector portion 62 to move the stop portions 60*a* and 60*b* of the leg portions 54*a* and 54*b* into and out engagement with the spool 41. To disengage the stop portions 60*a* and 60*b* of the control arm 52, a user pushes on the button 64, which causes the stop portions 60*a* and 60*b* to move away from or out of the teeth 44*a* or notches 44*b* and toward the seat 56. A bottom surface of the stop portions 60*a* and 60*b* can then confront and compresses the spring 59. With the stop portions 60*a* and 60*b* disengaged, the spool 41 is free to rotate in both directions. After the button 64 is released by the user, the tension in the spring 59 is released forcing the stop portions 60*a* and 60*b* toward engagement with the teeth 44*a* or notches 44*b*. Once engaged, the spool 41 will only rotate as described above depending upon if there are teeth 44*a* or notches 44*b*.

Referring to FIGS. 7A-7C, guide rails 66 may be formed or attached to the inner surface of the housing portions 21 and 22 to guide movement of the leg portions 54*a* and 54*b*. The guide rails 66 can consist of spaced apart protrusions, knobs, rails, and the like. So long as the guide rails 66 prevent lateral movement of the leg portions 54*a* and 54*b*, any shape may be used.

Continuing with FIGS. 7A-7C, in some embodiments, there can be at least one guide pin or eyelet 68 operatively disposed in the interior 23 of the housing 20 to guide the bungee cord 50 through opening 26. Guide pin 68 can include a rotating sleeve mounted on a pin that is formed on or attached to an inner surface of the housing 20. As illustrated in FIGS. 7A-7C, the guide pin 68 is preferably positioned adjacent to opening 26.

Attached to the free end of the bungee cord 50 can be a hook 70 for attaching to a loop or other type of securing device/structure. Any typical hook 70 that can be secured to the free end of the bungee cord 50 can be used. In one example embodiment of the invention, hook 70 comprises an adjustable hook that can be adjusted depending upon the hook size needed. In this embodiment, the hook 70 includes a plurality of interlocking joint segments that can be articulated with respect to adjacent segments. If needed a user can articulate the hook 70 to form a loop or the user can wrap the hook 70 around any structure.

A stopper 72 can be secured to the bungee cord 50 proximate the hook 70 to prevent the hook 70 from damaging the housing 20 when it is retracted into the interior of the housing 20. The stopper 72 can comprise a foam or rubber material. Any material can be used so long as it cushions the impact of the hook 70 against the housing 20.

Attached to the housing 20 can be a hook or other securing device 74 that is capable of detachably connecting the housing 20 to a loop or other structure. In one embodiment, the securing device 74 is a hook that is attached to an eyelet 75 formed on the housing 20. The eyelet 75 is preferably reinforced to be able to withstand the force exerted upon it by the bungee cord 50. The securing device 74 can comprise a hook as described above, a carabineer type device or any device that is capable of at least temporarily securing the housing 20 in a relatively fixed position. As illustrated in FIG. 7B, securing device 74 is rotatably mounted to the eyelet 75. In another embodiment, the securing device 74 includes a ball and socket mechanism to permit pivoting movement thereof.

Referring to FIGS. 2 and 7B, a cover 80 can be operatively coupled to the housing 20 to allow a user to selectively cover the button 46. The cover 80 can comprise a sheet 81 of plastic or similar material that can be nested in a slot 82 extending into the housing 20. A tab 83 is formed on the sheet to permit easy movement of the cover between a closed position and an open position.

In another embodiment of the invention, a retraction control mechanism can be operatively disposed to or in the housing 20 to control the rate of retraction of the bungee cord 50. In an example embodiment, a lever can be operatively disposed in the housing to engage at least a portion of the spool 41. A user can utilize the lever to engage the spool 41 and slow its rate of rotation and uptake of the bungee cord 50. In this embodiment, a portion of the lever is extendable from the housing for operation by a user. In another example embodiment, a button is operatively disposed to the housing 20 that can be engaged with the spool 41 or the bungee cord 50. In yet another embodiment, a slide is plate is operatively disposed to the housing 20 that can engage a portion of the bungee cord 50. In all embodiments, the rate of retraction the bungee cord 50 is controlled by the user. Other embodiments are possible where retractor is automatically controlled.

In use, the hook 70 attached to the bungee cord 50 is secured to a loop such as those attached to vehicles. The user then presses the button 64 which causes the stop portions 60*a* and 60*b* to move from the engaged position toward the disengaged position. Once in the disengaged position, the user holds the button 64 and pulls the housing 20 causing the bungee cord 50 move in the first direction out of the opening 23 of the housing 20. As the user gets close to another loop the user releases the button 64 which causes the stop portions 60*a* and 60*b* to move from the disengaged position toward the engaged position where they engage the teeth 44*a* or notches 44*b*. At this point the spool 41 will no longer rotate in the first direction. The user is then able to pull on the housing 20 and use the hook 74 to hook it to the other loop. By pulling on the housing 20 the user is able to increase the amount of tension in the bungee cord 50 which in turn regulates the amount of force on the item being secured.

Once the housing 20 is secured the user can slide the cover 80 over the button 64 to prevent accidental disengagement during travel by something contacting the button 64. Even if the button 64 is accidentally bumped or pressed the constant retracting force created by the biasing member 47 will keep the bungee cord 50 taut.

Once the user is done securing items he or she can retract the bungee cord 50 into the housing 20 in a number of ways. If teeth 44*a* are formed into the disks 43*a* 43*b* the user merely has to un-attach the housing 20 and move it toward the hook 70. There is no need to hold onto the button 64 in this embodiment since stop portions 60*a* and 60*b* are permitted to travel over the teeth 44*a* as the biasing member 47 moves in the second direction retracting the bungee cord 50 into the housing 20. If notches 44*b* are formed into the disks 43*a* and 43*b* the user must hold down the button 64 to disengage the stop portions 60*a* and 60*b*. While holding the button 64 and the housing 20, the user moves it toward the hook 70. As described above, the biasing member 47 automatically moves the spool 41 in the second direction retracting the bungee cord 50 into the housing 20.

What is claimed is:

1. A portable retractable tie down system comprising:

a housing defining an interior with at least one opening thereto;

a ratcheting mechanism operatively disposed in the interior of the housing;

an elastic member woundable about the ratcheting mechanism with a free end extendable through the opening in the housing;

an actuator operatively disposed on the housing to engage the ratcheting mechanism, wherein the ratcheting mechanism is free to move when the actuator is operated, whereby a length of the elastic member can be withdrawn from the interior of the housing; and a first securing member disposed on the free end of the elastic member; and a second securing member disposed on the housing.

2. The system of claim 1, wherein the housing includes a first housing portion and a second housing portion joined together to form the interior, wherein the ratcheting mechanism is operatively disposed between the first and second housing portions.

3. The system of claim 1, further comprising at least one type of geometry being imparted to an exterior surface of the housing.

4. The system of claim 3, wherein the at least one type of geometry can include at least one selected from the group comprising essentially of a plurality of ridges, grooves, and ribs.

5. The system of claim 1, further comprising a cover being disposed on at least a portion of the housing to protect the housing or items being secured from being damaged.

6. The system of claim 5, wherein the cover comprises a compressible material.

7. The system of claim 6, wherein the cover has an exterior surface comprising at least one selected from the group comprising essentially of a plurality of ridges, grooves, and depressions.

8. The system of claim 1, wherein the ratcheting mechanism comprises:

a spool having a hub disposed between disks, each of the disks having a plurality of grooves formed therein, the spool being rotatably mounted in the housing;

a biasing member operatively coupled to the hub to permit automatic retraction of the elastic member into the transportable housing; and a control arm operatively coupled between the grooves in at least one of the disks and the actuator to control engagement and disengagement of rotational movement of the spool.

9. The system of claim 8, wherein the plurality of grooves comprises at least one selected from the group comprising essentially of teeth and notches.

10. The system of claim 8, wherein the biasing member comprises a coiled spring operatively coupled to an interior surface of the hub and a portion of the housing, wherein the biasing member provides automatic retraction of the elastic member into the interior of the housing.

11. The system of claim 8, wherein the control arm comprises:

a cross member disposed in the interior of the housing and operatively coupled to the actuator;

a pair of spaced leg members extending from the cross member and along the disks of the spool such that the spool is disposed between the leg members;

at least one stop portion extending away from at least one of the leg members to engage the grooves of at least one of the disks; and at least one biasing member in operative engagement with at least one of the leg members to bias the at least one stop portion into engagement with the grooves of the disk.

12. The system of claim 11, wherein each of the leg members have a relative bow formed therein to provide for clearance of the spool.

13. The system of claim 1, further comprising a guide mounted in the transportable housing to guide the elastic member through the opening and onto the spool.

14. The system of claim 1, further comprising an attachment member disposed on a free end of the elastic member, wherein the free end of the elastic member is removably attached to a first attachment point to allow a user to move the housing thereby allowing a length of elastic member to be withdrawn from the housing.

15. The system of claim 1, wherein the second securing member comprises an adjustable hook having a plurality of interlocking joint segments that can be articulated with respect to adjacent segments.

16. The system of claim 1, further comprising a retraction control mechanism operatively disposed in the housing and engagable with the ratcheting mechanism to permit regulation of a rate of retraction of the elastic member into the interior of the housing.

17. The system of claim 16, wherein the retraction control mechanism comprises at least one selected from the group comprising essentially of a lever operatively disposed in the housing to engage at least a portion of a spool; a button operatively disposed to the housing that can be engaged with the at least a portion of the spool; and a slid plate operatively disposed to the housing that can engage at least a portion of the elastic member.

18. A method of securing items with a portable tie down device having a housing defining an interior and at least one opening thereto, a ratcheting mechanism operatively disposed in the interior of the housing, an elastic member woundable about the ratcheting mechanism with a free end extendable through the opening in the housing, a first securing member disposed on the free end of the elastic member, an actuator operatively disposed on the housing to engage the ratcheting mechanism so the ratcheting mechanism is free to move when the actuator is operated to permit a length of the elastic member to be withdrawn from the housing, and a second securing member disposed on the housing, the method comprising:

securing the first securing member to a first securing point;

moving the housing towards a second securing point having;

while pressing the actuator to permit a length of the elastic member to extend out of the housing;

releasing the actuator on the housing prior to reaching the second securing point to prevent the elastic member from being further withdrawn from the housing;

pulling the housing away from the first secure point to stretch the elastic member thereby increasing tension in the elastic member; and attaching the second securing member disposed on the housing to a second securing point.

19. A retractable tie down system comprising:

a portable housing having an interior and at least one opening thereto;

a spool having at least one disk, the spool being operatively disposed in the interior of the transportable housing;

a bungee cord wound about the spool with a free end extendable through the opening in the portable housing;

a first attachment member disposed on the free end of the bungee cord to removably attach the bungee cord to a first attachment point;

an actuator having at least one leg member in operative cooperation with the at least one disk of the spool, the spool being prevented from freely rotating in at least one direction when the at least one leg member is engaged with the at least one disk, the spool being free to rotate in two directions when the at least one leg member is disengaged from the at least one disk, wherein at least a portion of the bungee cord can be drawn out of the transportable housing when the at least one leg member and at least one disk are engaged or disengaged and wherein at least a portion of the bungee cord is retractable into the transportable housing when the at least one leg member and the at least one disk are disengaged; and a second attachment member disposed on a portion of the portable housing to removably secure the transportable housing to a second attachment point.

* * * * *

UNITED STATES PATENT AND TRADEMARK OFFICE

CERTIFICATE OF CORRECTION

PATENT NO. : 7,575,224 B1
APPLICATION NO. : 11/671941
DATED : August 18, 2009
INVENTOR(S) : Erik Madland It is certified that error appears in the above-identified patent and that said Letters Patent is hereby corrected as shown below:

Column 10, Claim 18, Lines 28-29 should read moving the housing towards a second securing point while pressing the actuator to permit a length of the elastic member to extend out of the housing;

Signed and Sealed this

Tenth Day of November, 2009

David J. Kappos

David J. Kappos
*Director of the United States Patent and Trademark Office*